United States Patent [19]

Weickert et al.

[11] Patent Number: 4,719,797

[45] Date of Patent: Jan. 19, 1988

[54] SPINNING ASSEMBLY FOR EXPLOSIVE MUNITIONS

[75] Inventors: Chris A. Weickert, Ralston; Thomas A. Storrie, Medicine Hat, both of Canada

[73] Assignee: Her Majesty the Queen in right of Canada, as represented by the Minister of National Defence, Canada

[21] Appl. No.: 886,006

[22] Filed: Jul. 16, 1986

[30] Foreign Application Priority Data

Aug. 14, 1985 [CA] Canada ..... 488729

[51] Int. Cl.[4] ..... G01M 19/00

[52] U.S. Cl. ..... 73/167; 73/865.3

[58] Field of Search ..... 73/167, 865.3, 865.6, 73/1 DC, 35

[56] References Cited

U.S. PATENT DOCUMENTS

| | | | |
|---|---|---|---|
| 2,353,150 | 7/1944 | Dietz | 73/167 |
| 2,640,355 | 6/1953 | Pigford | 73/167 |
| 2,655,033 | 10/1953 | Burrell | 73/167 |
| 3,138,021 | 6/1964 | Linn | 73/167 |
| 3,329,014 | 7/1967 | Stewart | 73/167 |
| 3,380,297 | 4/1968 | Stewart | 73/167 |
| 3,597,969 | 8/1971 | Curchack | 73/167 |
| 3,960,000 | 6/1976 | Barnett et al. | 73/167 |
| 4,033,185 | 7/1977 | McNally et al. | 73/167 |
| 4,467,639 | 8/1984 | Bush | 73/167 |
| 4,487,067 | 12/1984 | Stebbins et al. | 73/865.3 |

*Primary Examiner*—Charles Frankfort
*Assistant Examiner*—Thomas B. Will
*Attorney, Agent, or Firm*—Larson and Taylor

[57] ABSTRACT

In the testing of explosive munitions, particularly sub-munitions such as self-forging fragment and shaped charge devices, the munitions are spun about a longitudinal axis to simulate a spin-stabilized munition. An assembly for spinning the munition includes a stationary hub, a rotating hub and an arrangement for mounting the munition concentrically on the hub. A detonator mount positions a detonator and an explosive booster on the axle near the explosive. The stationary mounting of the detonator and booster allows a safer disarming of the munition in the event of misfire.

5 Claims, 5 Drawing Figures

SPINNING ASSEMBLY FOR EXPLOSIVE MUNITIONS

FIELD OF THE INVENTION

The present invention relates to an assembly for spinning explosive munitions, particularly sub-munitions including self-forging fragment and shaped charge devices for testing purposes.

BACKGROUND

Various types of sub-munitions, including self-forging fragment and shaped charge devices are parts of munition packages. When the munition is launched, it is commonly spun about a longitudinal axis to ensure aerodynamic stability. Consequently, when the sub-munition is detonated, it is spinning. If the spin rate is too high, the result can be a malformed shaped charge jet or self-forging fragment. It is therefore necessary to have a device which can spin the sub-munitions at the required spin rate and then detonate them in order to study the effect of spin on a particular sub-munition design.

The apparatus now used for spinning sub-munitions for testing purposes includes a shaft, bearing and pulley system or an arrangment for suspending the sub-munition vertically by means of a wire. In either case, the entire sub-munition is spun, including the detonator, booster and the main explosive charge. This is undesireable as the detonator and the booster contain highly sensitive explosive. In the event of a misfire, the detonator must be removed in order to disarm the device. The spinning of the detonator at high spin rates increases the chances of an accidental ignition while it is being removed.

SUMMARY OF THE INVENTION

The present invention is concerned with the provision of a novel form of spinning apparatus that is not subject to the disadvantages of the prior art.

According to the present invention there is provided an assembly for spinning an explosive device about an axis, comprising:

a stationary axle;

a hub mounted for rotation on the axle and securable to the device;

detonator mounting means for mounting a detonator and an explosive booster on the axle adjacaent but spaced from the device; and drive means for rotating the hub on the axle.

With this arrangement the detonator and the booster are not subject to spin and therefore less likely to ignite accidentally.

BRIEF DESCRIPTION OF THE DRAWINGS

In the accompanying drawings, which illustrate exemplary embodiments of self-forging fragment and shaped charge devices and an exemplary embodiment of the present invention.

DETAILED DESCRIPTION

Figure 1:
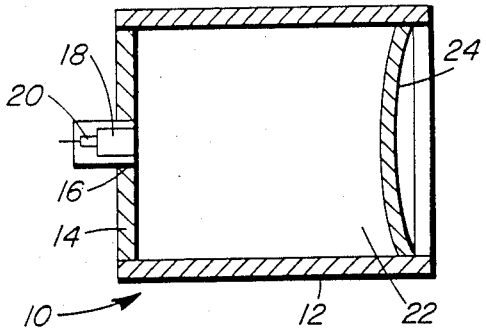
FIG. 1 is a cross-sectional view of a self-forging fragment device.
Figure 2:
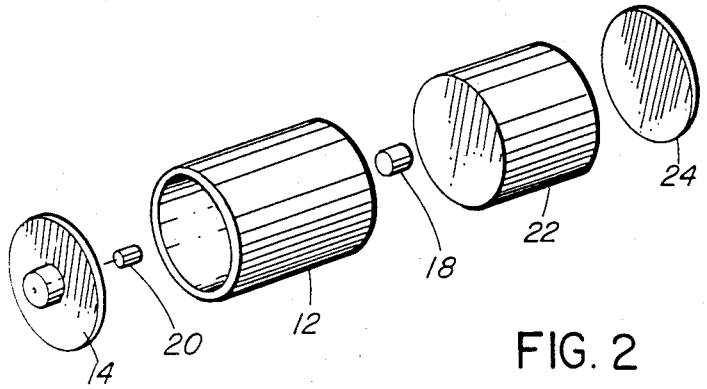
FIG. 2 is an exploded view of the device of FIG. 1.

Referring to the drawings, FIGS. 1 and 2 illustrate a self-forging fragment device 10. The device has a body 12 closed at one end by an end plate assembly 14 with an apparature 16 to receive the booster 18 and a detonatorr 20. The body is filled with an explosive 22 and is closed by a saucer-shaped liner 24.

Figure 3:
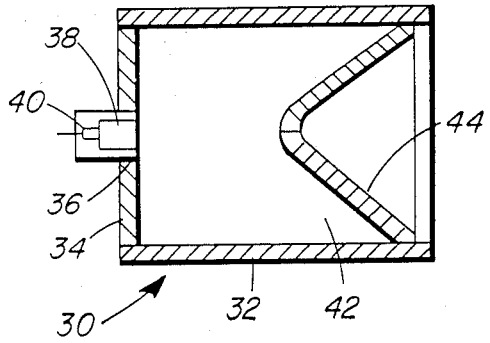
FIG. 3 is a cross-sectional view of a shaped charge device.
Figure 4:
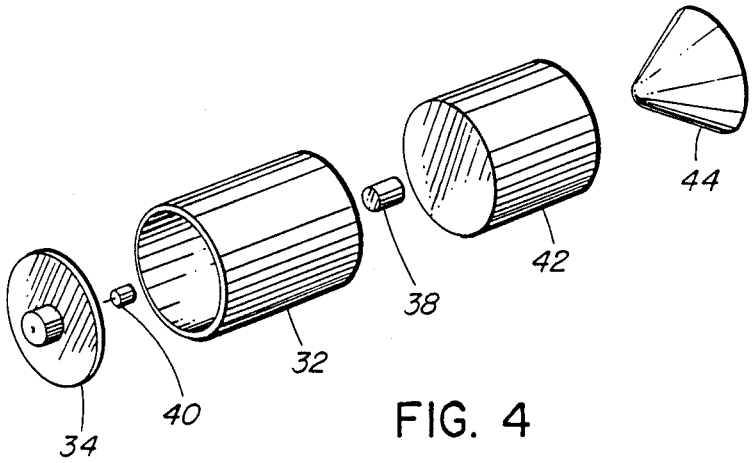
FIG. 4 is an exploded view of the shaped charge device of FIG. 3.

As illustrated in FIGS. 3 and 4, the shaped charge device is similar in configuration to the self-forging fragment device. It includes a cylinder body 32 with an end plate assembly 34 having an aperture 36 to receive the booster 38 and detonator 40. The body 32 is filled with an explosive 42 and is closed by a conical liner 44.

In both of the devices illustrated in FIGS. 1 through 4, the detonator and booster are integral parts of the submunition so that when the submunition is spun for testing purposes, the detonator and booster are spun as well. As noted in the foregoing, this is an undesirable arrangement as, in the event of a misfire, the spun detonator is more likely to ignite accidentally when it is being removed.

Figure 5:
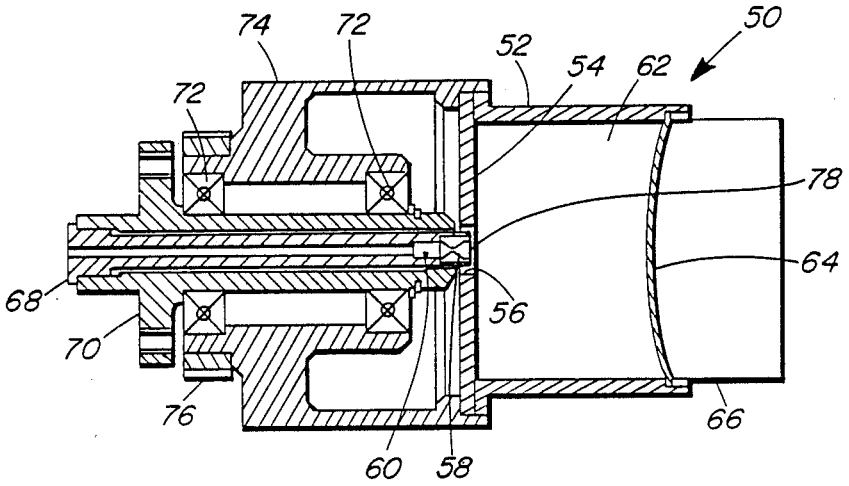
FIG. 5 is a cross-sectional view of an assembly according to the present invention.

FIG. 5 illustrates an apparatus which the detonator and booster are stationary during spinning of the submunition, in this case a self-forging fragment device 50. The device 50 has a cylindrical body 52 closed by an end plate 54. The end plate is centrally apertured at 56 to expose the explosive 62 filling the body 52. The body is closed with a dished liner 64, itself covered with a urethane foam plug 66.

In this embodiment, the booster 58 and detonator 60 are carried on the end of a brass detonator tube 68 that extends the length of a hollow axle 70. The detonator tube and axle are so located relative to the end plate 54 of the device 50 that the booster 58 is located in the aperture 56 in the end plate, spaced slightly from the explosive 62. The axle 70 carries two bearings 72 which mount hub 74 for rotation on the stationary axle. The body 52 of the device 50 is fastened to the hub 74 for rotation with the hub.

The hub 74 is equipped with a toothed pulley 76 so that it can be driven at a known spin rate by a timing belt.

An air gap 78 is maintained between the booster 58 and the explosive 62. The use of the stationary booster 58 and stationary detonator 60 ensures that the more sensitive components of the system were not spun, thus improving safety.

While one specific embodiment of the invention has been described in the foregoing, it is to be understood that the invention is not limited to that embodiment. The scope of the invention is to be ascertained solely by reference to the appended claims.

We claim:

1. An assembly for spinning an explosive device about an axis, comprising:

a stationary axle;

a hub mounted for rotation on the axle and having means for securing the explosive device to the hub;

detonator mounting means for mounting a detonator and an explosive booster on the axle adjacent but spaced from the explosive device; and drive means for rotating the hub on the axle.

2. An assembly according to claim 1, wherein the axle is hollow and the detonator mounting means comprises a detonator tube extending through the hollow axle.

3. An assembly according to claim 1, wherein the detonator and booster are mounted on the axis at an end of the axle.

4. An assembly according to claim 1, wherein the explosive device is a self forging fragment device.

5. An assembly according to claim 1, wherein the explosive device is a shaped charge device.

* * * * *